US005917287A

United States Patent [19]

Haederle et al.

[11] Patent Number: 5,917,287

[45] Date of Patent: Jun. 29, 1999

[54] OPERATING CIRCUIT FOR HIGH-PRESSURE DISCHARGE LAMPS WITH AN IGNITION-TIME BRIDGING FUNCTION

[75] Inventors: Markus Haederle, Gruibingen; Josef Osterried, Ottobrunn, both of Germany

[73] Assignee: Patent-Treuhand-Gesellschaft fuer elektrische Gluehlampen mbH, Munich, Germany

[21] Appl. No.: 09/045,395

[22] Filed: Mar. 20, 1998

[30] Foreign Application Priority Data

Mar. 21, 1997 [DE] Germany ..... 297 05 183.0 U

[51] Int. Cl.[6] ..... H05B 37/02

[52] U.S. Cl. ..... 315/136; 315/307; 315/DIG. 4; 315/209 R

[58] Field of Search ..... 315/209 R, 129, 315/131, 136, 307, DIG. 4

[56] References Cited

U.S. PATENT DOCUMENTS

| | | | |
|---|---|---|---|
| 3,246,201 | 4/1966 | Michalski | 315/136 |
| 3,599,036 | 8/1971 | Haymaker | 315/136 |
| 3,611,432 | 10/1971 | Babcock | 315/136 |
| 3,659,146 | 4/1972 | Munson | 315/136 |
| 3,699,382 | 10/1972 | Franke | 315/136 |
| 4,091,307 | 5/1978 | McNamara, Jr. | 315/136 |
| 5,051,665 | 9/1991 | Garrison et al. | 315/307 |
| 5,115,165 | 5/1992 | Knoble | 315/136 |
| 5,225,742 | 7/1993 | Beasley | 315/307 |
| 5,381,077 | 1/1995 | McGuire | 315/DIG. 4 |

*Primary Examiner*—Michael B. Shingleton
*Attorney, Agent, or Firm*—Carlo S. Bessone

[57] ABSTRACT

The circuit for operating a high-pressure gas discharge lamp (HID) has a device (ZZÜ) for ignition-time bridging by switching in a second lamp (GL), the ignition-time bridging device (ZZÜ) being driven by a signal (S) indicating the operating state of the high-pressure discharge lamp (HID), and the drive signal (S) being an output signal of a power controller (R) of the circuit.

5 Claims, 3 Drawing Sheets

OPERATING CIRCUIT FOR HIGH-PRESSURE DISCHARGE LAMPS WITH AN IGNITION-TIME BRIDGING FUNCTION

BACKGROUND OF THE INVENTION

The invention relates to an operating circuit for a high-pressure gas discharge lamp. A particular problem of high-pressure gas discharge lamps consists in that they can usually be ignited only in a cold state, that is to say only after a certain cooling phase after the last operation.

The disadvantage that the lamp cannot be used during this period, which can take approximately 2 to 10 minutes, has led to the development of special hot igniters for high-pressure gas discharge lamps. However, a general application of these hot igniters is obstructed by the considerable technical outlay associated with them and the costs thereby occasioned.

A substantially simpler alternative consists in providing a second lamp, in general a simple incandescent lamp, which can bridge the cooling or dark phase. Of course, an attempt is made for the operating circuit of the high-pressure gas discharge lamp to switch in this incandescent lamp independently when an operator would like to switch on the high-pressure discharge lamp, but the latter cannot be ignited. It has been conventional to provide for this purpose a very complicated electronic system which detects the voltage drop across the high-pressure gas discharge lamp, reaches a conclusion on the burning state and switches in the incandescent lamp if required. An example is the Tridonic LRM 300 ignition-time bridging unit. This unit is estimated to contain between 50 and 80 electronic components and requires a volume of approximately 7×40×30 mm, specifically in each case exclusively for the ignition-time bridging function. This technical outlay and the costs and overall size associated therewith are regarded as being very disadvantageous.

SUMMARY OF THE INVENTION

The invention is therefore based on the technical problem of providing an operating circuit for a high-pressure gas discharge lamp which renders an ignition-time bridging function possible in a technically simple way.

This problem is solved by means of a circuit for operating a high-pressure gas discharge lamp having a device for ignition-time bridging by switching in a second lamp, in which the ignition-time bridging device is driven by a signal indicating the operating state of the high-pressure discharge lamp, characterized in that the drive signal is an output signal of a power controller of the circuit.

Further embodiments according to the invention are the subject-matter of the subclaims.

According to the invention, the operating circuit thus has a power controller whose output signal supplies the information on the burning state of the high-pressure gas discharge lamp. It is to be considered in this case that high-pressure gas discharge lamps exhibit a thermal power increase, and that therefore in the case of more recent operating circuits power controllers are provided in any case to control the power of the high-pressure gas discharge lamp.

A simple possibility, which is technically advantageous in many regards, of driving an ignition-time bridging device results from this power controller and the utilisation of this output signal as information source on the burning state of the lamp. Firstly, it appears to be advantageous that the signal indicating the burning state of the high-pressure gas discharge lamp is tapped not, as in the conventional case, in the circuit section between the power supply and the high-pressure gas discharge lamp, but outside thereof. Firstly, in this circuit section the tap is generally relatively lossy and lowers the efficiency of the operating circuit. Secondly, a tap in the circuit section leads at many points to AC or AC-voltage signals which must first be rectified. Furthermore—depending, in turn, on the precise tapping point in the said circuit section—the ignition-time bridging device would have to be designed with regard to the ignition pulses occurring there in the current or in the voltage.

For the rest, the term "power controller" is to be understood in this application to mean that, in the final analysis, it is ensured that the high-pressure gas discharge lamp has a largely constant power in continuous operation. Of course, this also covers those cases in which a current or a voltage in the operating circuit is the variable actually controlled, and, nevertheless, the same aim of power control is being followed thereby.

The output signal of the controller need not, moreover, necessarily be the last manipulating variable. It can, for example, firstly control a pulse-width modulator which actuates a circuit-breaker, for example in a DC/DC converter.

The controller output signal also has the advantage in many cases that it is possible to eliminate a separate reference variable comparator for determining the burning state. To be precise, comparison is already undertaken in any case in the power controller.

Advantages result, in particular, for those cases in which the controller output signals occurring in continuous operation of the high-pressure gas discharge lamp are too small or deviate too little from the controller output signal in the case of the desired value detected to be able to trigger the driven ignition bridging device.

In accordance with one embodiment according to the invention, it can be provided, in particular, that in the case of downward deviations in the lamp power which are so large that they do not occur in continuous operation, the characteristic of the power controller behaves in a quasi-"digital" fashion. This means that the output signal in such cases leaves a value range in which control is exercised during continuous operation with respect to small fluctuations, and is changed into another value range or to another fixed value (for example frame potential) for an intermediate interval traversed only for a relatively short time (for example controller integration time).

Thus, upon starting the high-pressure gas discharge lamp such a controller characteristic leads through the last mentioned value range or value to an "acceleration" of the desired power which is as rapid and direct as possible, and then "topples" into the value range of continuous operation shortly before reaching this desired power and carries out the fine control in this range during continuous operation. This control characteristic leads with the output signal deviating from the continuous operation to a variable which can be used directly to drive a simple driver circuit or a simple circuit-breaker of the ignition-time bridging device. The additional outlay required for the ignition-time bridging function is thereby limited to a minimum.

The ignition-time bridging device which is to be triggered by means of the drive signal described can then, according to the invention, be designed in a different way. In the simplest case, it is a transistor switch or thyristor switch in a supply line of the second lamp. Since in this case it is generally only rectified currents which can be switched, the supply for the second lamp is advantageously tapped in the rectified range of the power supply of the high-pressure gas discharge lamp. However, it can also be tapped in the AC range and then traverse a separate rectifier.

Electrical separation inside the ignition-time bridging device can, furthermore, be sensible with regard, chiefly, to different frame reference potentials in the region of the power supply of the high-pressure gas discharge lamp, on the one hand, and in the output range of the controller, on the other hand. Consequently, a relay switch or an optocoupler can be used, the latter driving a switch element which, for its part, does not separate, for example a TRIAC, in the case of a non-rectified supply of the second lamp.

The invention is explained below with the aid of a plurality of concrete exemplary embodiments in the figures. The features disclosed in the process can, however, also be essential to the invention individually or in other combinations.

BEST MODE FOR CARRYING OUT THE INVENTION

Figure 1:
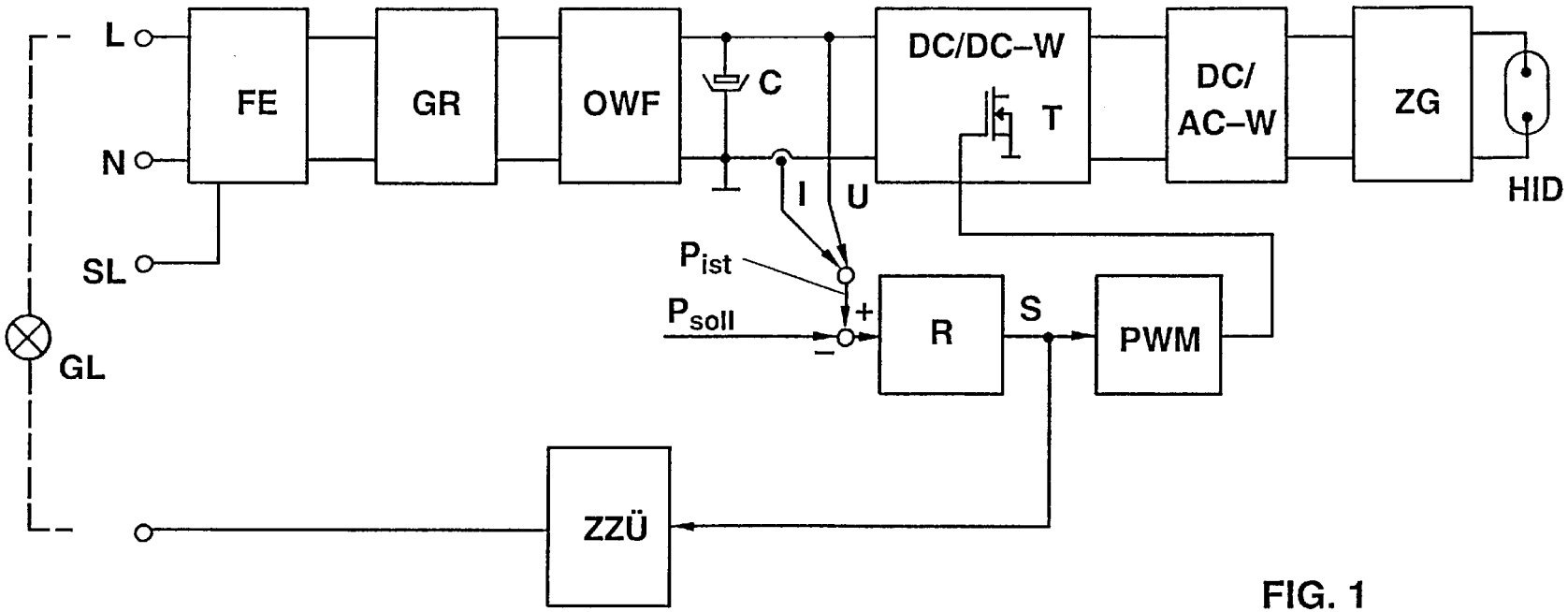
FIG. 1 shows a block diagram of an operating circuit according to the invention.

FIG. 1 shows a diagrammatic overview of the design of an operating circuit according to the invention. Extending from left to right in the upper region is a circuit section of a conventional AC power supply having a phase conductor L, normal conductor N and protective conductor SL via a radio interference suppresser FE, a rectifier GR, an active harmonic filter OWF downstream of which an electrolytic capacitor C is arranged, furthermore via a power-controlled DC/DC converter DC/DC-W, a DC/AC converter DC/AC-W and an igniter ZG to a high-pressure gas discharge lamp denoted by HID. Between the harmonic filter OWF and the DC/DC converter, a voltage U and a current I are tapped, multiplied to form an actual power $P_{ACTUAL}$ and compared with a prescribed reference value $P_{DESIRED}$. The difference forms the input signal of a controller R. The output signal S of the latter is fed to a pulse-width modulator PWM which drives a power transistor as switch element in the DC/DC converter. The output signal S of the controller R is applied as information on the burning state of the lamp to an ignition-time bridging device ZZÜ which is described in more detail below and controls the power supply of an incandescent lamp GL serving as second lamp. The representation makes clear that the drive signal S is tapped outside the direct circuit section between the power supply L, N, SL above left and the high-pressure gas discharge lamp HID above right. It rather originates from the power controller R, which in the present case controls the output power of the DC/DC converter. This is performed by the pulse-width modulator PWM and the switching transistor T indicated in the DC/DC converter.

Because of the high input voltage and the low input current of the converter tapping the power $P_{ACTUAL}$ detected by the power controller R upstream of the DC/DC converter has the advantage of being determined with a very low loss. Its power loss is known and can therefore be taken into account when fixing the reference variable $P_{DESIRED}$.

The output signal S of the power controller R is a zero potential, that is to say an output signal corresponding to its frame potential, when the power $P_{ACTUAL}$ detected is substantially lower than the reference variable $P_{DESIRED}$. As soon as $P_{ACTUAL}$ comes into the vicinity of the value of $P_{DESIRED}$, the output signal S jumps within a relatively short integration time of a few 10 ms to a value above 50% of the maximum value of its voltage supply. The fine control in continuous operation of the high-pressure gas discharge lamp HID is performed in the value region above this 50%.

The zero value of the drive signal S thus corresponds to the information "lamp does not burn" for the ignition-time bridging device ZZÜ, which correspondingly enables the power supply for the incandescent lamp GL.

Figure 2:
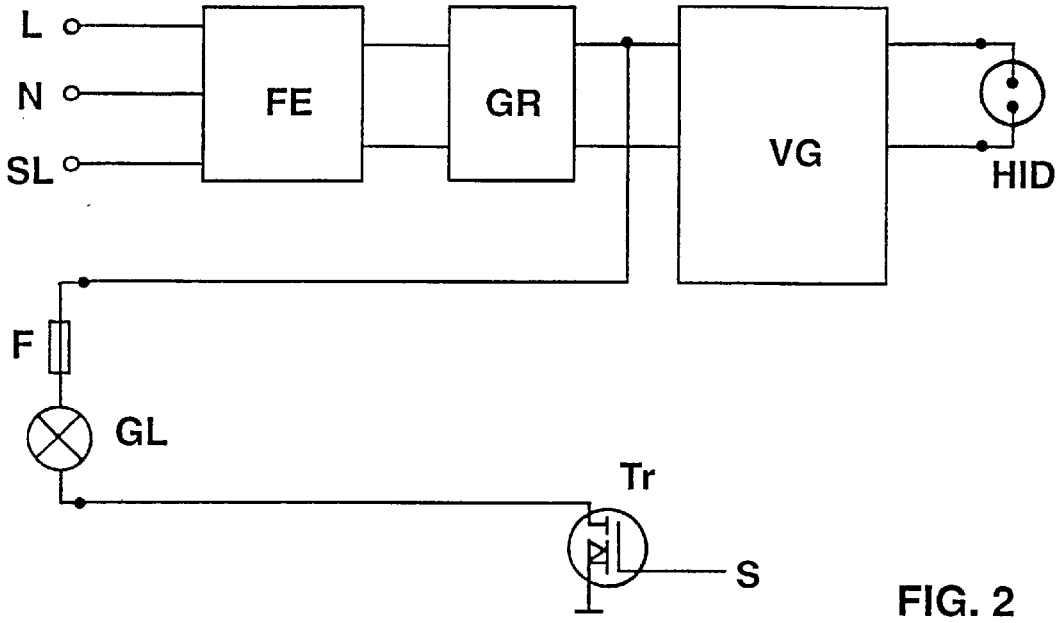
FIGS. 2 to 5, respectively, show one possibility for an ignition-time bridging device.

The circuit section between the power supply L, N, SL and the high-pressure gas discharge lamp HID is represented in FIG. 2, as in all following figures, in a simplified fashion, specifically reduced to the radio interference suppresser FE, the rectifier GR and, in a combined fashion, the remaining circuit elements of the section, the ballast VG. The ignition-time bridging device here comprises a switch element or transistor Tr situated between the incandescent lamp GL and frame. Drive signal S drives the gate of the switching transistor Tr. The other side of the incandescent lamp GL is connected via a fuse F to the rectified phase conductor between the rectifier GR and the ballast VG. FIG. 2 thus incorporates a particularly simple embodiment of the ignition-time bridging device ZZÜ.

Figure 3:
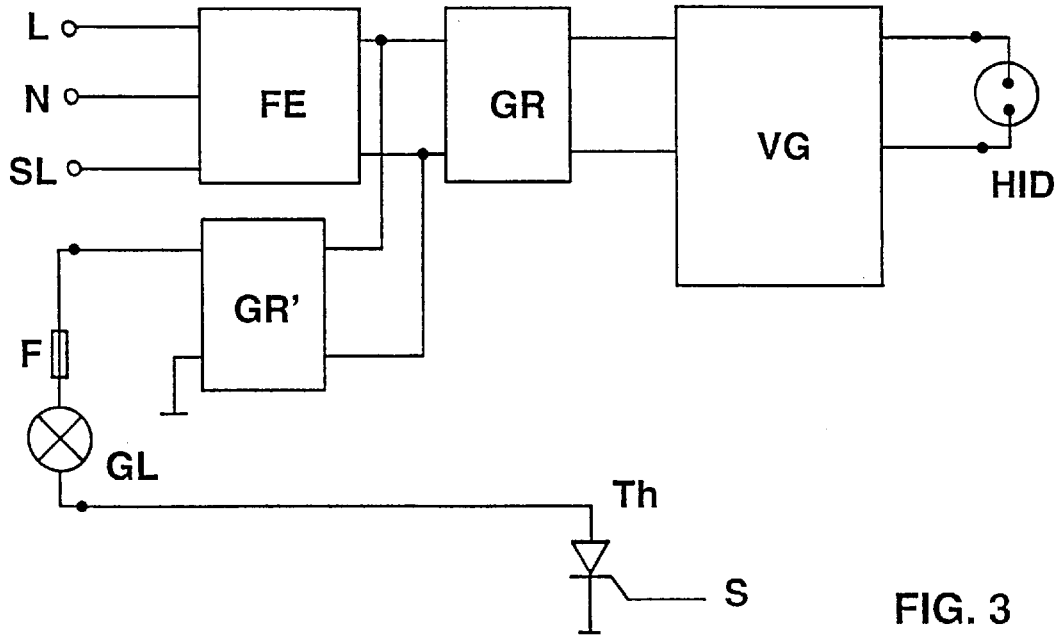

This also applies largely to FIG. 3, in which the switch element is incorporated by a thyristor switch Th. Furthermore, the other side of the incandescent lamp GL is connected here to the output of a separate rectifier GR', whose input is connected to the power supply between the radio interference suppresser FE and the rectifier of the high-pressure gas discharge lamp supply GR.

Figure 4:
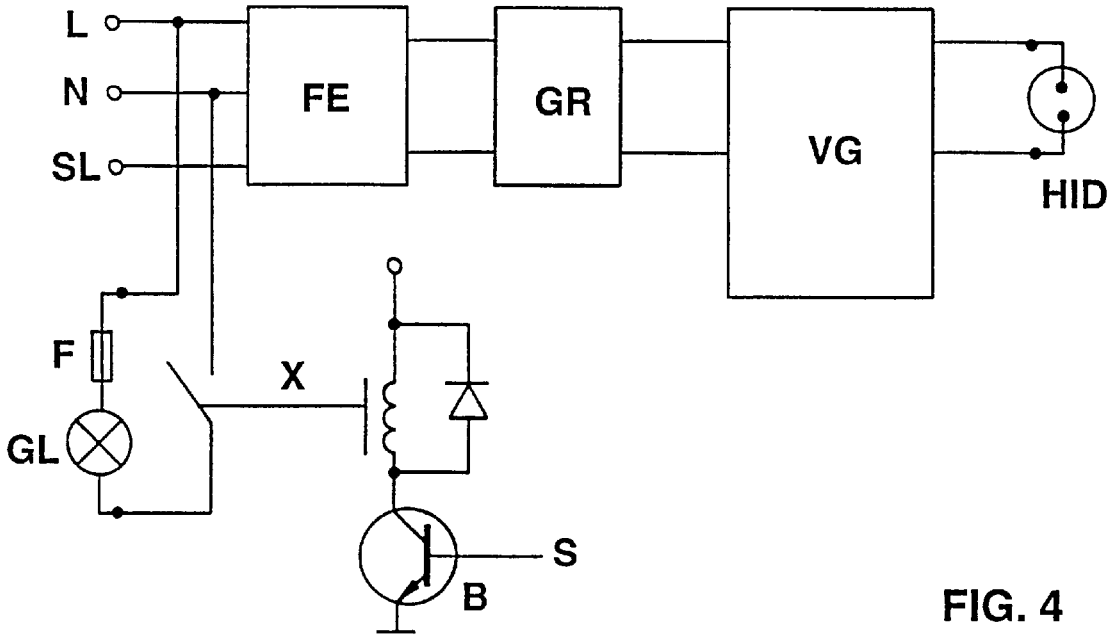

In FIG. 4, the terminals of the incandescent lamp GL are already connected on the side of the power supply upstream of the radio interference suppresser FE. One of the terminals is interrupted by a relay switch X which, as shown, is actuated with the aid of a bipolar transistor B, to whose base the drive signal S is applied. This circuit has the advantage of electrical isolation between the incandescent lamp circuit and the drive signal S.

Figure 5:
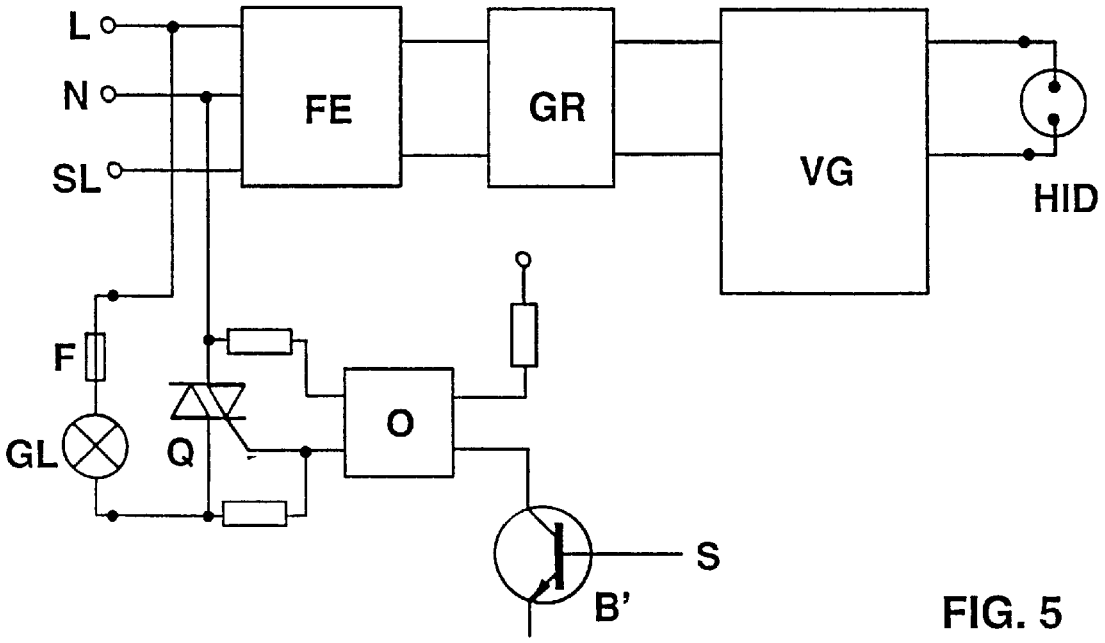

The embodiment of the ignition-time bridging device ZZ Ü shown in FIG. 5 largely corresponds to this. However, instead of the relay a TRIAC denoted by Q is used here as switch element, which is driven via an optocoupler O and a bipolar transistor B'. The optocoupler O serves the purpose of electrical isolation here.

What is claimed is:

1. A circuit for operating a high-pressure gas discharge lamp (HID) having a device (ZZÜ) for ignition-time bridging by switching in a second lamp (GL), in which the ignition-time bridging device (ZZÜ) is driven by a signal (S) indicating the operating state of the high-pressure gas discharge lamp (HID), characterized in that the drive signal (S) is an output signal of a power controller (R) of the circuit, the power controller (R) has a control characteristic which, when the power of the high-pressure gas discharge lamp (HID) is below a predetermined power value, changes the output signal of the power controller from a first value range of continuous power control to a second value range or to a fixed value for an intermediate interval.

2. The circuit according to claim 1, in which the drive signal (S) is applied to a thyristor circuit (Th) situated in a supply line of the second lamp (GL).

3. The circuit according to claim 1, in which the drive signal (S) is applied to a transistor circuit (Tr) situated in a supply line of the second lamp (GL).

4. The circuit according to claim 1, in which the drive signal (S) is applied to a relay switch (X) situated in a supply line of the second lamp (GL).

5. The circuit according to claim 1, in which the drive signal (S) uses an optocoupler (O) to drive a switch element situated in a supply line of the second lamp (GL).

* * * * *